US007579539B2

(12) United States Patent
Chen

(10) Patent No.: US 7,579,539 B2
(45) Date of Patent: Aug. 25, 2009

(54) ADJUSTABLE DRUM PEDAL ASSEMBLY

(76) Inventor: Kuo-Chang Chen, No. 32, Doutan Rd., Shalu Chen, Taichung Hsien (TW)

( * ) Notice: Subject to any disclaimer, the term of this patent is extended or adjusted under 35 U.S.C. 154(b) by 0 days.

(21) Appl. No.: 11/866,919

(22) Filed: Oct. 3, 2007

(65) Prior Publication Data

US 2008/0017015 A1 Jan. 24, 2008

Related U.S. Application Data

(63) Continuation-in-part of application No. 11/339,909, filed on Jan. 25, 2006, now abandoned.

(51) Int. Cl.
*G10D 13/02* (2006.01)

(52) U.S. Cl. ..... 84/422.1; 84/411 R

(58) Field of Classification Search ..... 84/422.1
See application file for complete search history.

(56) References Cited

U.S. PATENT DOCUMENTS 3,797,356 A * 3/1974 Duffy et al. ..... 84/422.1
4,691,613 A 9/1987 Jacobson
4,819,536 A 4/1989 Lombardi
4,945,802 A 8/1990 Ruprecht
5,379,674 A 1/1995 Hoshino
5,388,494 A 2/1995 Hoshino
5,714,701 A * 2/1998 Hsieh ..... 84/422.1
6,028,259 A 2/2000 Lombardi et al.
6,894,210 B1 * 5/2005 Lombardi ..... 84/422.1
6,903,257 B2 6/2005 Yun
2004/0060421 A1 * 4/2004 Yun ..... 84/426

* cited by examiner

*Primary Examiner*—Jeffrey Donels
*Assistant Examiner*—Christopher Uhlir
(74) *Attorney, Agent, or Firm*—The Maxham Firm

(57) ABSTRACT

An adjustable drum pedal assembly has a rotated shaft, a drive device and a chain. The rotated shaft has a fixed bracket formed on the rotated shaft and has a screwed hole. The drive device is mounted on the rotated shaft and has a base, a mounting panel and a bolt. The base is combined with the fixed bracket and has an adjusting groove, a mounting recess, a securing hole and an elongated through hole. The mounting panel is mounted to the rear end of the base. The bolt is screwed into the screwed hole. The chain is mounted between the drive device and the drum pedal and has a fastener screwed into the securing hole in the base to connect the chain to the drive device.

1 Claim, 7 Drawing Sheets

ADJUSTABLE DRUM PEDAL ASSEMBLY

The present invention is a continuation-in-part of application Ser. No. 11/339,909 filed on Jan. 25, 2006.

BACKGROUND OF THE INVENTION

1. Field of the Invention

The present invention relates to a drum pedal assembly, and more particularly to an adjustable drum pedal assembly for adjusting positions of the pedal conveniently and rapidly.

2. Description of Related Art

With reference to FIGS. 6 and 7, a drum pedal assembly (50) generally comprising a bottom board (51), two posts (52), a drum pedal (53), a rotated shaft (54), a drive device (55) and a chain (56).

The bottom board (51) has a distal end and a proximal end, and the posts (52) are mounted on and extend upward from the bottom board (51) near the distal end and face to each other. Each post (52) has a distal end, a proximal end and a connecting hole. The proximal end of the post (52) is mounted on the bottom board (51), and the connecting hole is defined through the distal end of the post (52). The drum pedal (53) is pivotally connected to the bottom board (51) and has a pivotal end and an action end. The pivotal end of the drum pedal (53) is connected to the bottom board (51) by a pivotal pin.

The rotated shaft (54) is connected rotatably between the posts (52) and has two ends, a connected bracket (541) and a drum hammer (542). The ends of the rotated shaft (54) are respectively mounted into the connecting holes of the posts (52). The connected bracket (541) is mounted on the rotated shaft (54) and has a distal end, a proximal end and a through hole. The through hole is defined near the proximal end of the connected bracket (541) and has a noncircular cross section. The rotated shaft (54) has a noncircular cross section corresponding to that of the through hole in the connecting bracket (541) and extends through the through hole to make the connecting bracket (541) to rotate with the rotated shaft (54). The drum hammer (542) is attached to the connected bracket (541) near the distal end.

The drive device (55) is mounted on the rotated shaft (54) and has a top, a bottom, two sides, a securing hole (551), a fastener (552), a side through hole (553), a bottom hole and a bolt (554). The securing hole (551) is formed in the top of the drive device (55) and the fastener (552) is screwed into the securing hole (551). The side through hole (553) through which the rotated shaft (54) extends is formed through the drive device (55) between the two sides and has a noncircular cross section corresponding to that of the rotated shaft (54). The bottom hole is formed in the bottom of the drive device (55) and communicates with the side through hole (553). The bolt (554) is mounted into the bottom hole and contacts with the rotated shaft (54), such that the drive device (55) is rotated with the rotated shaft (54).

The chain (56) is connected between the drum pedal (53) and the drive device (55) and has a proximal end, a distal end and a connecting plate (561). The distal end of the chain (56) is connected to the action end of the drum pedal (53). The connecting plate (561) is mounted on the proximal end of the chain (56) and has a through hole (562). The fastener (552) extends through the through hole (562) in the connecting plate (561) and is screwed into the securing hole (551) in the drive device (55) to connect the proximal end of the chain (56) to the drive device (55).

When a user treads on the drum pedal (53), the chain (56) will pull the drive device (55) and the rotated shaft (54) to rotate so as to make the drum hammer (542) to swing to hit a drum.

However, the drum pedal assembly (50) only has a securing hole (551), so the position of the chain (56) connected to the drive device (55) is not adjustable such that the conventional drum pedal assembly (50) is not versatile in use.

SUMMARY OF THE INVENTION

The main objective of the present invention is to provide a drum pedal assembly that is adjustable and versatile in use.

An adjustable drum pedal assembly in accordance with the present invention has a rotated shaft, a drive device and a chain. The rotated shaft has a fixed bracket formed on the rotated shaft and has a screwed hole. The drive device is mounted on the rotated shaft and has a base, a mounting panel and a bolt. The base is combined with the fixed bracket and has an adjusting groove, a mounting recess, a securing hole and an elongated through hole. The mounting panel is mounted to the rear end of the base. The bolt is screwed into the screwed hole. The chain is mounted between the drive device and the drum pedal and has a fastener screwed into the securing hole in the base to connect the chain to the drive device.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
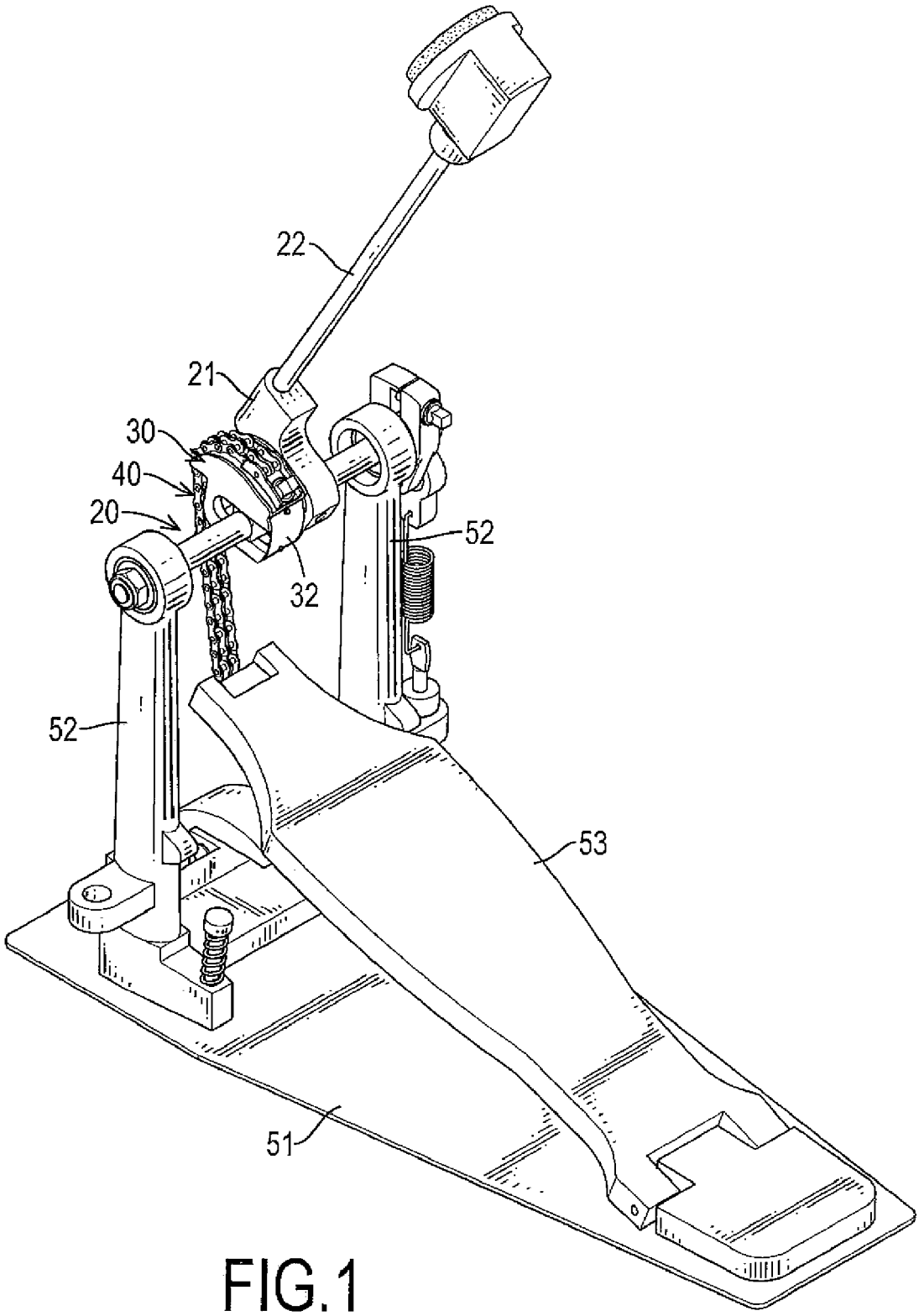
FIG. 1 is a perspective view of an adjustable drum pedal assembly in accordance with the present invention.
Figure 2:
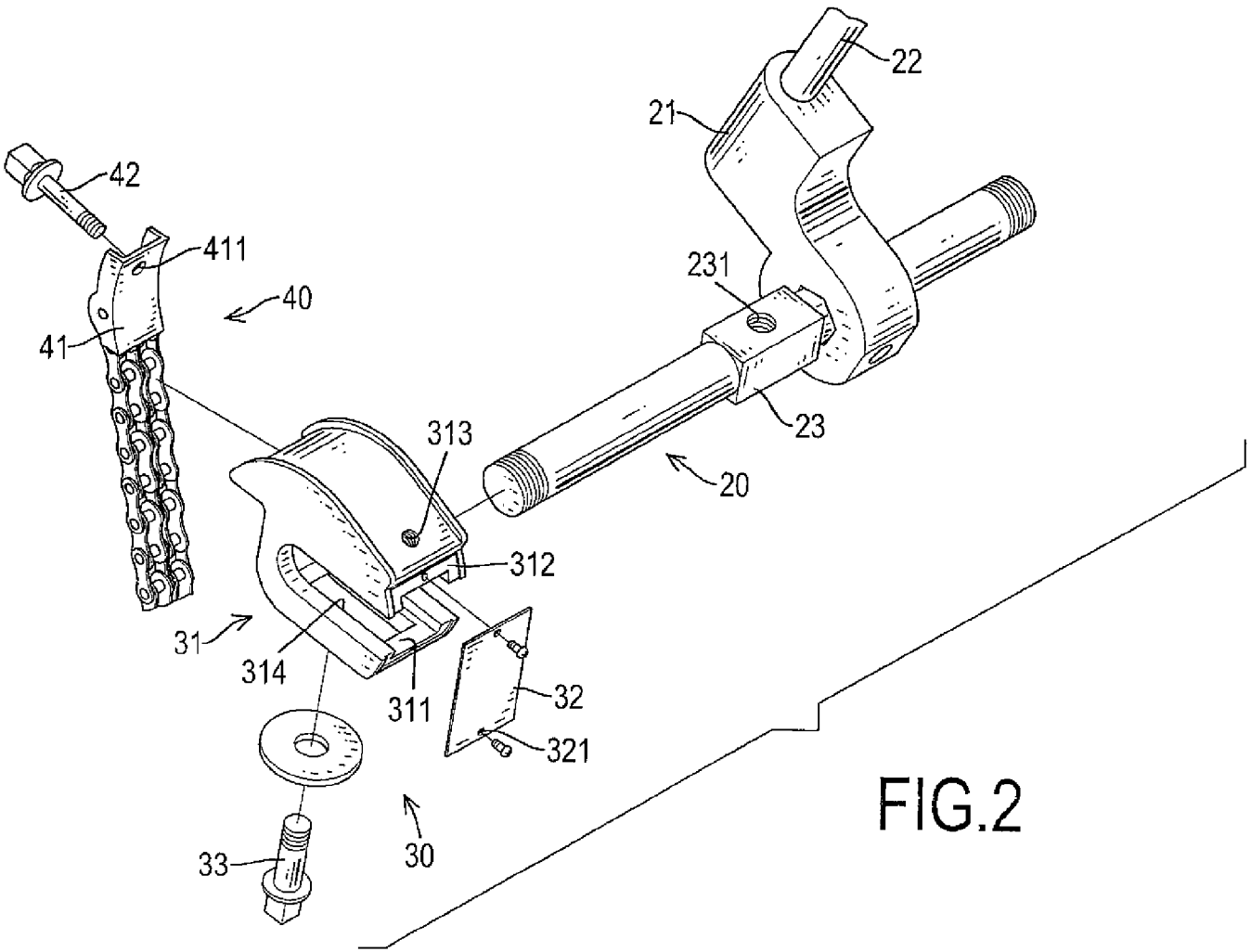
FIG. 2 is an exploded perspective view of the adjustable drum pedal assembly in FIG. 1.

With reference to FIGS. 1 to 4, an adjustable drum pedal assembly (10) in accordance with the present invention comprises a bottom board (51), two posts (52), a drum pedal (53), a rotated shaft (20, a drive device (30) and a chain (40).

Figure 6:
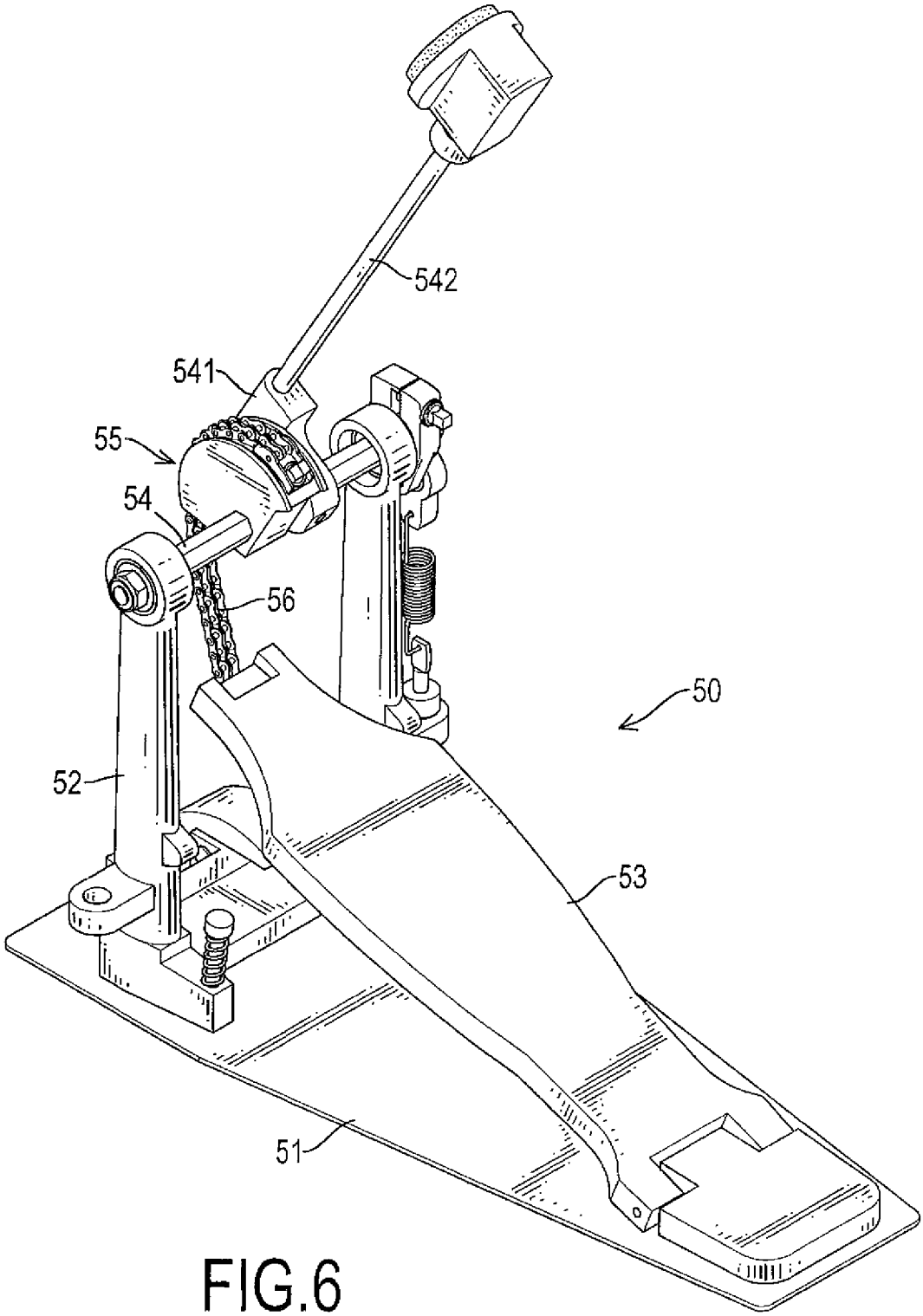
FIG.6 PRIOR ART
FIG. 6 is a perspective view of a conventional drum pedal assembly in accordance with the prior art.
Figure 7:
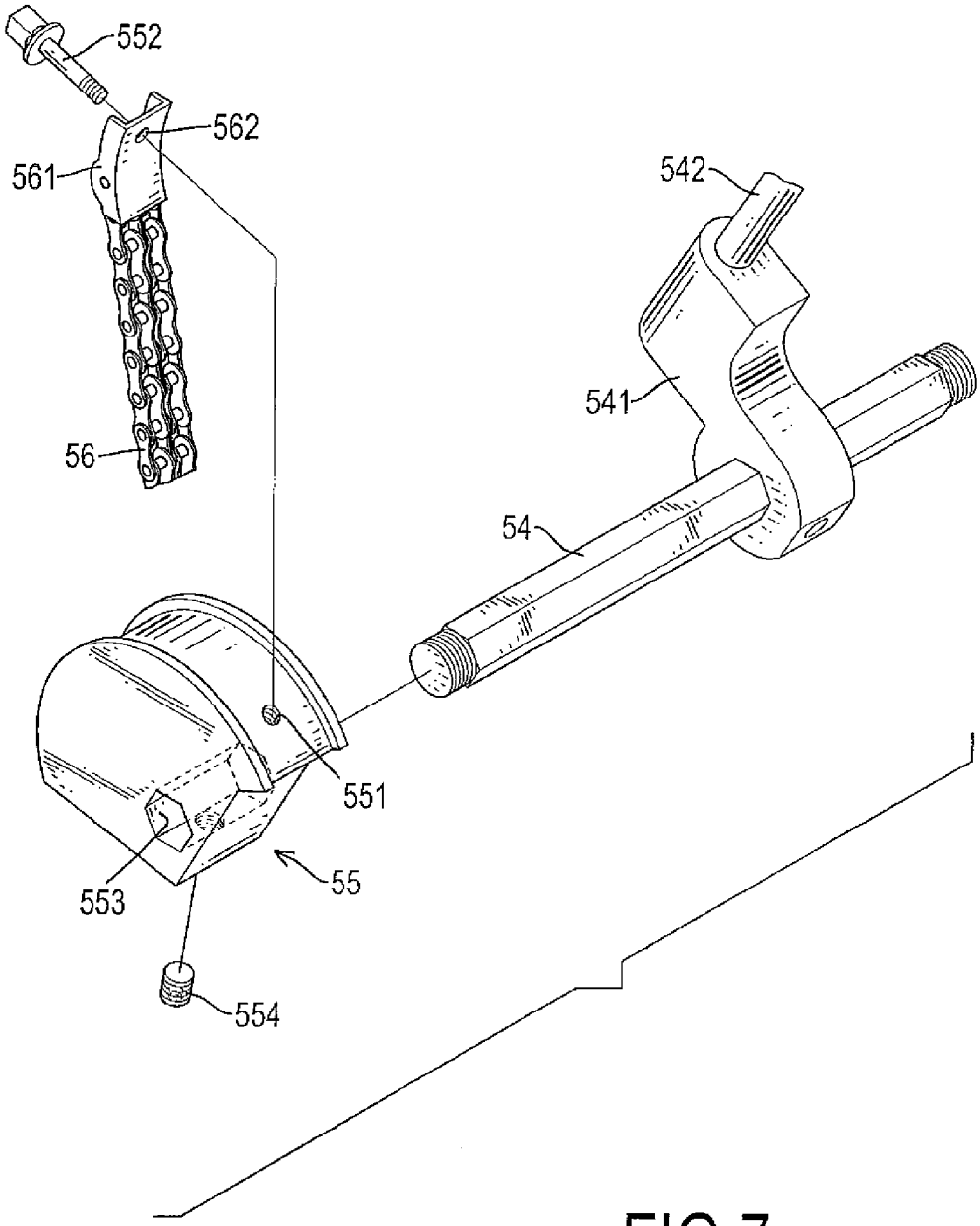
FIG.7 PRIOR ART
FIG. 7 is a partially exploded perspective view, of the conventional drum pedal assembly in FIG. 6.

The bottom board (51), two posts (52) and the drum pedal (53) may have structures sane as that of the conventional drum pedal assembly (50) as shown in FIG. 6 and do not be further described.

The rotated shaft (20) is connected rotatably between the posts (52) and has two ends, a connecting bracket (21), a drum hammer (22) and a fixed bracket (23). The ends of the rotated shaft (20) are respectively mounted in the connecting holes of the posts (52). The connecting bracket (21) is mounted on the rotated shaft (20) and has a distal end, a proximal end and a through hole. The through hole is formed near the proximal end of the connected bracket (21) and is mounted around the rotated shaft (20). The drum hammer (22) is attached to the connected bracket (21) near the distal end. The fixed bracket (23) is formed on the rotated shaft (20) and has a top, a bottom and a screwed hole (231). The screwed hole (231) is defined through the fixed bracket (23) from the top to the bottom of the fixed bracket (23).

The drive device (30) is mounted on the fixed bracket (23) of the rotated shaft (20) and has a base (31), a mounting panel (32) and a bolt (33). The base (31) is combined with the fixed bracket (23) and has a top, a bottom, two sides, a front end, a rear end, an adjusting groove (311), a mounting recess (312), a securing hole (313) and an elongated through hole (314). The adjusting groove (311) is defined through the sides of the base (31) between the top and the bottom and has an opened end formed through the rear end of the base (31), and the fixed bracket (23) is held movably inside and engages with the adjusting groove (311) from the opened end. The mounting recess (312) is formed on the rear end of the base (31) and communicates with the opened end of the adjusting groove (311) and has a bottom and two mounting holes. The mounting holes are formed on the bottom of the mounting recess (312) beside the open end of the adjusting groove (311). The securing hole (313) is formed in the top of the base (31). The elongated through hole (314) is formed through the bottom of the base (31) between the front end and the rear end and communicates with the adjusting groove (311). The mounting panel (32) is mounted in the mounting recess (312) of the base (31) and has two mounting holes (321). The mounting holes (321) are formed through the mounting panel (32) and align with the mounting holes in the mounting recess (312). The bolt (33) extends through the through hole (314) and is screwed into the screwed hole (231) in the fixed bracket (23) and the base (31) can be adjusted the location between the rotated shaft (20) by the fixed bracket (23) moving in the adjusting groove (311).

The chain (40) is mounted between the drive device (30) and the action end of the drum pedal (53), and has a proximal end, a distal end, a connecting plate (41) and a fastener (42). The distal end of the chain (40) is connected to the action end of the drum pedal (53). The connecting plate (41) is mounted on the proximal end of the chain (40) and has a through hole (411). The through hole (411) is formed through the connecting plate (41) and aligns with the securing hole (313) in the base (31). The fastener (42) extends through the through hole (411) in the connecting plate (41) and is screwed into the securing hole (313) in the base (31) to connect the proximal end of the chain (40) to the drive device (30).

Figure 3:
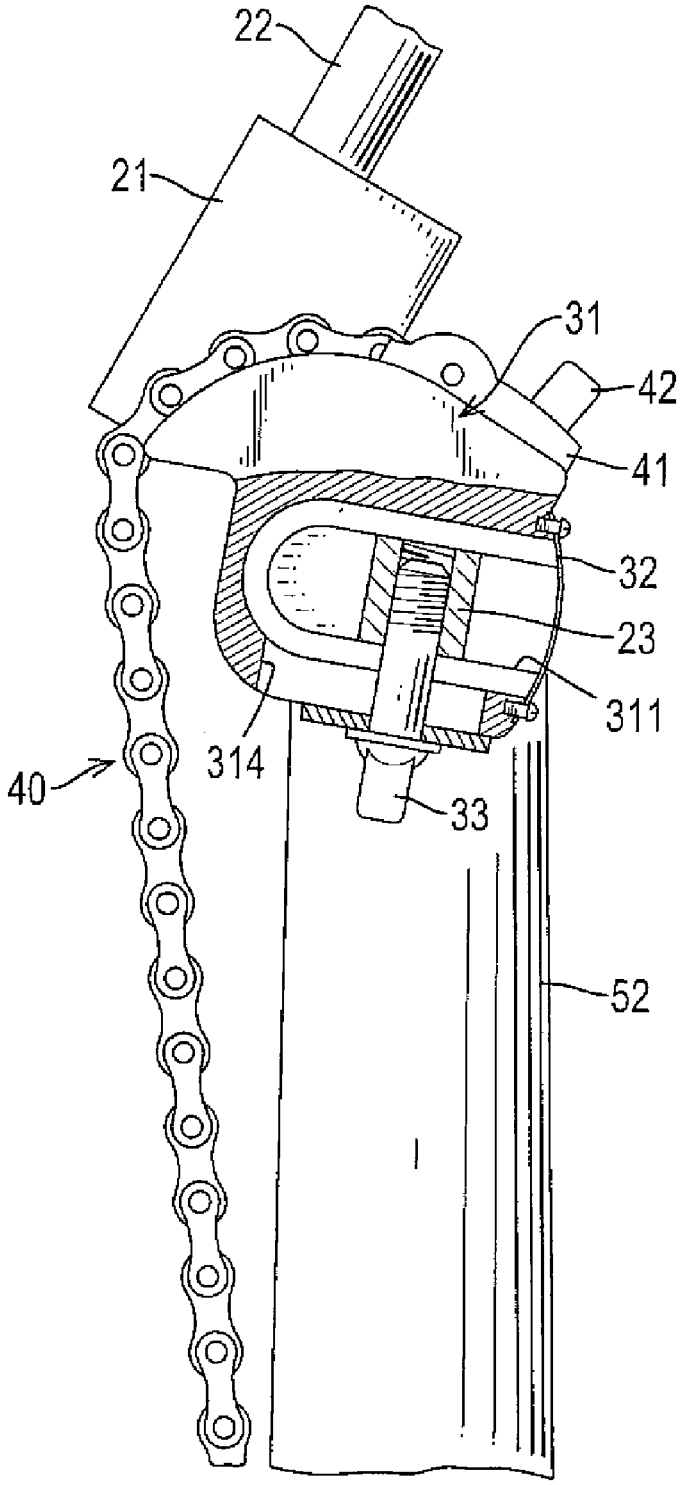
FIG. 3 is a side view in partial section of the adjustable drum pedal assembly in FIG. 1.
Figure 4:
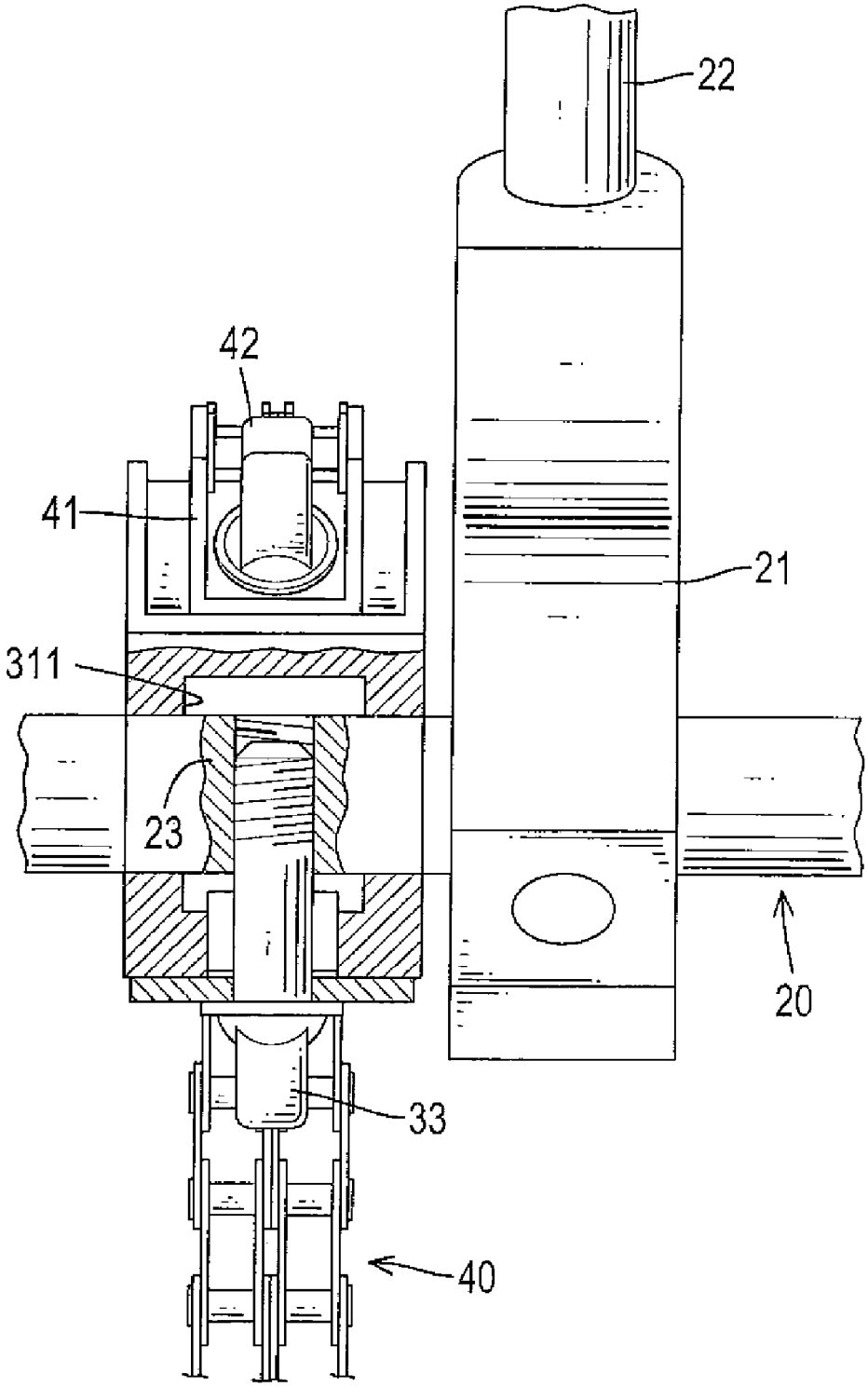
FIG. 4 is a front view in partial section of the adjustable drum pedal assembly in FIG. 1.
Figure 5:
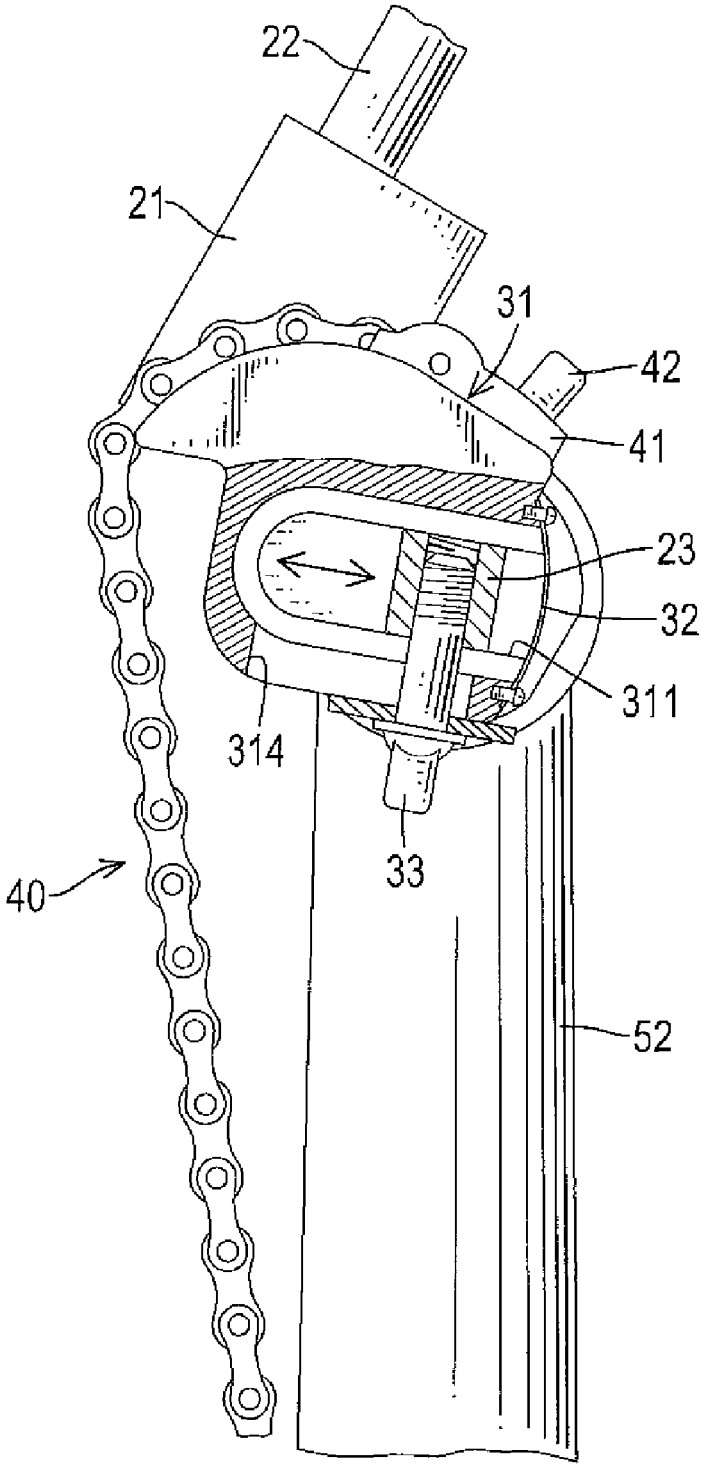
FIG. 5 is an operational side view in partial section of the adjustable drum pedal assembly in FIG. 1.

With reference to FIGS. 3 and 5, after loosening the bolt (33) from the screwed hole (231), the base (31) can be moved relative to the fixed bracket (23) by the adjusting groove (311). Consequently, the position of the chain (40) will be changed relative to the rotated shaft (20), such that the distance between the bottom board (51) and the drum pedal (53) is adjusted.

The adjustable drum pedal assembly (10) as described has the following advantages:

1. The drum pedal assembly (10) has the adjusting groove (311) in the drive device (30), and position of the chain (40) relative to the rotated shaft (20) can be changed. Thus, the height of the drum pedal (53) relative to the bottom board (51) can be adjusted based on the user's needs.

2. When assembling the drive device (30) with the rotated shaft (20), the user does not need to separate the rotated shaft (20) from the posts (52) and this is convenient in use.

3. The fastener (42) and the bolt (33) can firmly combine the base (31) and the drive shaft (20) together to provide a stability structure of the drum pedal assembly (10).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An adjustable drum pedal assembly comprising:

a bottom board comprising:
- a distal end; and
- a proximal end;

two posts being mounted on the bottom board near the distal end, facing to each other and each post having
- a distal end;
- a proximal end being mounted on the bottom board; and
- a connecting hole being defined through the distal end of the post;

a drum pedal being pivotally connected to the bottom board and having
- a pivotal end being connected to the bottom board; and
- an action end;

a rotated shaft being connected rotatably between the posts and having
- two ends being respectively mounted in the connecting holes of the posts;
- a connecting bracket being mounted on the rotated shaft and having
  - a distal end;
  - a proximal end; and
  - a through hole being formed through the proximal end of the connected bracket and being mounted around the rotated shaft;
- a drum hammer being attached to the connecting bracket near the distal end of the connecting bracket; and
- a fixed bracket being formed on the rotated shaft and having
  - a top;
  - a bottom; and
  - a screwed hole being defined though the fixed bracket from the top to the bottom of the fixed bracket;

a drive device being mounted on the fixed bracket of the rotated shaft and having
- a base being mounted around and combined with the fixed bracket hand having
  - a top;
  - a bottom;
  - two sides;
  - a front end;
  - a read end;
  - an adjusting groove being defined through the sides of the base between the top and the bottom to hold and engage with the fixed bracket and having an opened end formed through the rear end of the base;
  - a mounting recess being formed on the rear end of the base and communicating with the opened end of the adjusting groove and having
    - a bottom; and
    - two mounting holes being formed on the bottom of the mounting recess beside the opened end of the adjustment groove;
  - a securing hole being formed in the top of the base; and an elongated through hole being formed through the bottom of the base between the front end and the rear end and communicating with the adjusting groove;

a mounting panel being mounted in the mounting recess of the base having two mounting holes formed through the mounting panel and aligning with the mounting holes in the mounting recess;

a bolt being extended through the elongated through hole in the base and being screwed into the screwed hole in the fixed bracket; and a chain being mounted between the drive device and the drum pedal and having a proximal end;

a distal end being connected to the action end of the drum pedal; and a connecting plate being mounted on the proximal end of the chain and having a through hole formed through the connecting plate and aligning with the securing hole in the base; and a fastener extending through the through hole in the connecting plate and being screwed into the securing hole in the base to connect the proximal end of the chain to the drive device.

* * * * *